United States Patent [19]
Holtrop
[11] 4,418,610
[45] Dec. 6, 1983

[54] ELECTROHYDRAULIC CONTROL SYSTEM

[75] Inventor: John W. Holtrop, Ridgecrest, Calif.
[73] Assignee: The United States of America as represented by the Secretary of the Navy, Washington, D.C.

[21] Appl. No.: 185,036
[22] Filed: Sep. 8, 1980
[51] Int. Cl.³ ..... F15B 9/10
[52] U.S. Cl. ..... 91/368; 91/375 R; 244/3.21; 92/31
[58] Field of Search ..... 91/368, 385, 375 R, 91/216 A, 365, 384; 92/31, 33; 244/3.21, 3.24

[56] References Cited

U.S. PATENT DOCUMENTS

| | | | |
|---|---|---|---|
| 3,003,474 | 10/1961 | Giles et al. | 91/384 |
| 3,112,902 | 12/1963 | Kongelbeck | 244/3.21 |
| 3,154,015 | 10/1964 | Muller | 244/3.21 |
| 3,171,329 | 3/1965 | Rasmussen | 91/365 |
| 3,255,806 | 6/1966 | Meyer et al. | 160/188 |
| 3,276,332 | 10/1966 | Jaffe | 244/3.21 |
| 3,319,925 | 5/1967 | Kojima et al. | 92/33 |
| 3,329,069 | 7/1967 | Feroy | 92/33 |
| 3,357,182 | 12/1967 | Jacoby | 92/31 |
| 3,403,873 | 10/1968 | Bell et al. | 244/3.21 |
| 3,417,667 | 12/1968 | Ikebe et al. | 91/375 R |
| 3,457,836 | 7/1969 | Henderson | 91/368 |
| 3,711,040 | 1/1973 | Carver | 244/3.21 |
| 3,899,956 | 7/1973 | Olsen | 91/368 |

FOREIGN PATENT DOCUMENTS

| | | | |
|---|---|---|---|
| 47-50559 | 12/1972 | Japan | 91/368 |

*Primary Examiner*—Paul E. Maslousky
*Attorney, Agent, or Firm*—R. F. Beers; W. T. Skeer

[57] ABSTRACT

An electrohydraulic control system with mechanical position sensing feedback is presented. A movable flight control canard is rotatably operated for providing flight control of the missile. A hydraulically powered actuator is mounted to the airframe with the canard being secured to the actuator shaft for controlled rotation of the canard. Hydraulic fluid under pressure enters the actuator at its base controlled via a rotary valve. A stepper motor is mounted to the canard and is geared to drive the rotary valve as determined by digital control signals generated by the missile guidance computer. When the stepper motor receives a train of pulses, the stepper motor rotor rotatingly moves the rotary valve from the null or closed position to an open position admitting hydraulic fluid into the rotary actuator causing the canard to turn. The stepper motor rotates along with the canard and provides position feedback for closing the rotary valve when the canard has reached the equilibrium position determined by the control signal.

4 Claims, 4 Drawing Figures

ELECTROHYDRAULIC CONTROL SYSTEM

BACKGROUND OF THE INVENTION

The present invention relates to an electrohydraulic control system for controlling the position of a movable member, and more particularly, to an electrohydraulic control system for positioning a canard of a missile for controlling the flight path of the missile as determined by an on-board missile guidance computer.

Control canards for missiles are usually made of solid metal and are attached to an actuator through bearings located in the airframe. The canard must withstand heavy aerodynamic loading which requires large and bulky components. These components rotate as determined by control signals generated by the missile guidance computer. The actuator mechanism for the canards is also large and bulky and often has a slow dynamic response due to the inertia of the system. Therefore it is desirable to provide a missile control system with improved dynamic response.

Heretofore, the major components of a typical canard system were buried deep within the missile interior due to the bulk of the members. With the canard control system components being disposed deep within the missile interior, maintenance of the system in the event of malfunction presented a substantial difficulty since the components were very difficult to service. As a result, when a control problem became apparent, it was usually more economical to replace the entire missile.

SUMMARY OF THE INVENTION

An electrohydraulic system for positioning a movable member in response to a control signal is presented. The movable member is secured to an actuator means for movement by the actuator in response to hydraulic fluid under pressure. The hydraulic fluid is controlled by a valve, the control state of the valve being responsive to the position of the movable member. A stepper motor is connected to the hydraulic valve for controlling the valve in response to a control signal. The stepper motor is also mounted to the movable member for movement therewith thereby moving the hydraulic valve in response to the position of the movable member and providing mechanical feedback means of the position of the movable member to the valve. In this manner when the movable member has arrived at the predetermined position as determined by the control signal, the valve will be turned off thereby locking the movable member at the predetermined position.

OBJECTS OF THE INVENTION

Referring to the background of the invention hereinabove, accordingly it is an object of the present invention to provide a control system for the canard of a missile which is small enough to mount on the surface of the airframe. Another object of the present invention is to provide a control system for the canard of a missile wherein the dynamic response of the system is substantially quicker than that of the prior art. Still another object of the present invention is to provide a control system for the canard of a missile wherein the control system is positioned near the surface of the missile for easy access for repair or maintenance. Yet another object of the present invention is to provide a control system for the canard of a missile wherein the hydraulically powered actuator, the hydraulic valve for controlling the actuator, and the electromechanical motor for controlling the hydraulic valve in response to a control signal, are all rotatable about the axis of rotation of the canard. A further object of the present invention is to provide a control system for the canard of a missile wherein the electromechanical motor for controlling the hydraulic system is mounted to the canard for providing mechanical position feedback means for turning off the hydraulic valve of the system upon the canard attaining the predetermined position as determined by the control signal.

Further objects and advantages of the present invention will become apparent as the following description proceeds and the features of novelty characterizing the invention will be pointed out with particularity in the claims annexed to and forming a part of this specification.

DESCRIPTION OF THE DRAWINGS

For a better understanding of the present invention reference may be had to the accompanying drawings wherein.

DETAILED DESCRIPTION OF THE PREFERRED EMBODIMENT

Figure 1:
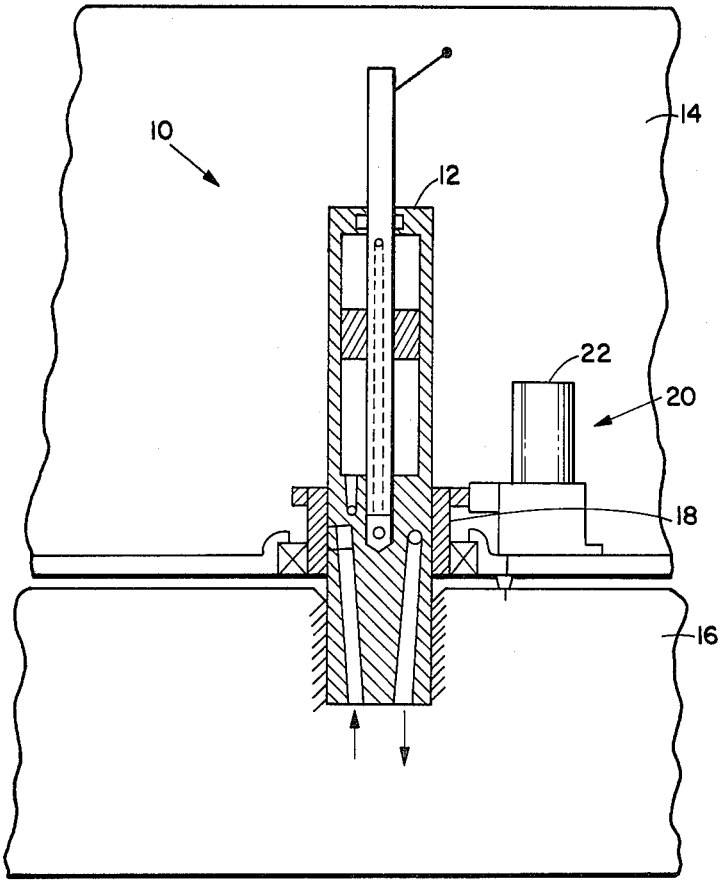
FIG. 1 shows a portion of a canard mounted to an electrohydraulic control system for movement with respect to a portion of the missile airframe with members of the electrohydraulic control system being shown in cutaway section.

Referring now to the drawings wherein the same reference numerals have been applied to like parts, FIG. 1 shows an electrohydraulic control system, generally designated 10, comprising a hydraulically powered actuator 12 upon which a movable member such as a canard or the like 14 is mounted for controlled rotational movement with respect to a reference supporting member such as an airframe body or the like 16. Hydraulic fluid under pressure for powering the actuator 12 is controlled by a rotary hydraulic valve 18 disposed at the base of the actuator 12 and concentric therewith. The state of the valve 18 is controlled by a stepper motor 20 in response to digital control signals generated by a computer, and in the case of a missile, usually an on board missile guidance computer unless the missile happens to be radio controlled from an external source. The housing 22 of the stepper motor is secured to the canard 14 for rotation therewith about the rotation axis of the actuator 12. The securement of the housing 22 to the canard 14 provides mechanical position feedback in the control system 10 for determining that the canard has achieved the position determined by the control signal and turning off the valve 18 when the canard has so acquired the predetermined position.

More particularly, the electrohydraulic control system of the present invention is designed for securement close to the surface of the airframe 16 for easy removal and repair. Additionally, placement of the electrohydraulic control system close to the surface of the airframe requires that the size and mass of components be reduced which additionally provides a benefit of improved response time to the control signals.

Figure 2:
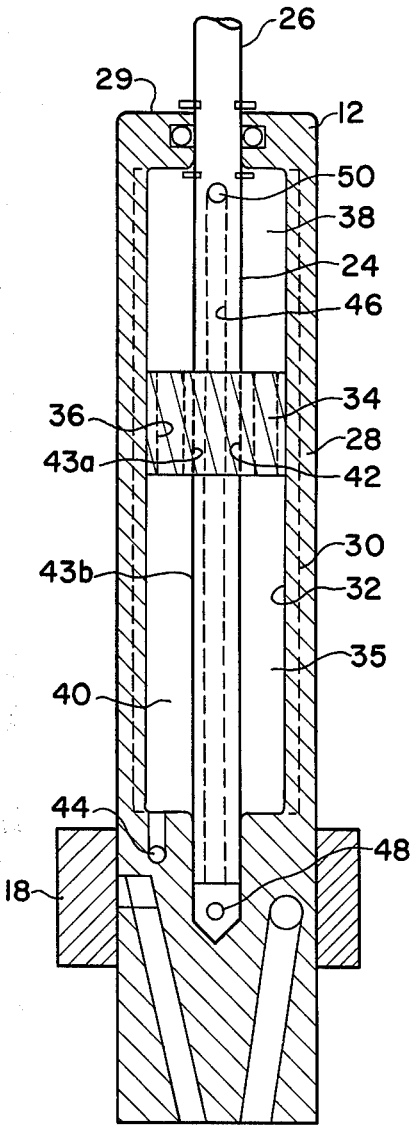
FIG. 2 shows, on an enlarged scale, a cutaway view of the actuator of FIG. 1.
Figure 4:
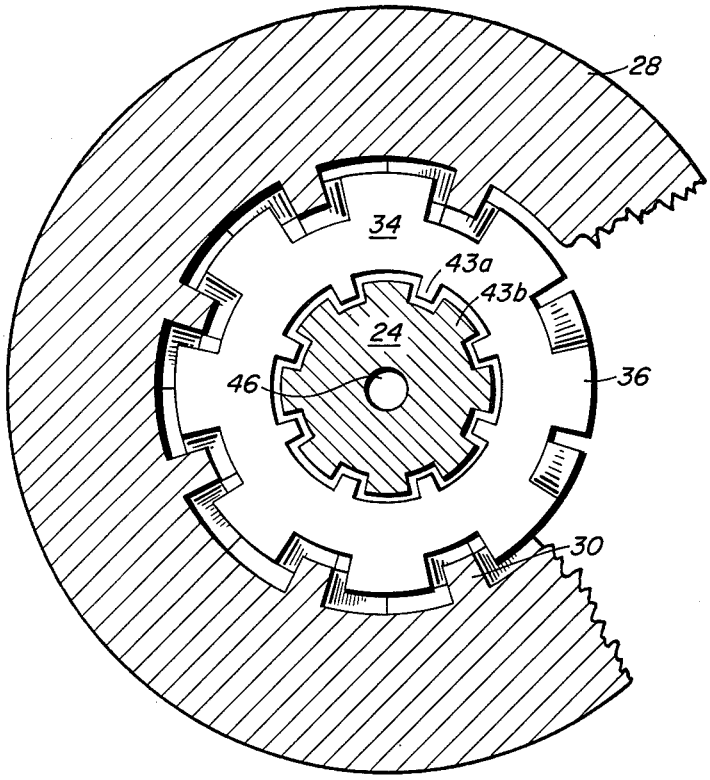
FIG. 4 shows a plan view, partially in section and partially cut away, of the piston, shaft and housing.

Referring now to FIGS. 1, 2 and 4 the canard 14 is schematically illustrated as being secured to end 26 of powered rotatable shaft 24 of actuator 12 for rotation with respect to the airframe 16. The actuator 12 comprises a hollow cylindrical housing 28 having an upper portion 29 providing a bearing surface upon which the canard 14 rotates. A helical thread or angled splines 30 are formed on the inner surface 32 of housing 28. A piston 34 is disposed within a bore 35 of the housing 28 and is provided with complimentary angled splines 36 matingly fitting splines 30 and forming a seal between upper cavity portion 38 and a lower cavity portion 40. The total twist of the angled splines 30 and 36 determines the desired amount of canard rotation as the piston 34 is hydraulically driven up and down.

The piston 34 is provided with a central axial bore 42 with vertical splines 43*a* provided therein. The shaft 24 is provided with complimentary vertical splines 43*b* at the outer surface thereof for free axial movement between the shaft 24 and the piston 34. Thus, as the piston 34 is moved along the axial length of the shaft 24, the piston 34 will be rotated by the engaged angled splines 30, 36 about the axis of the shaft 24 and the shaft 24 will in turn be rotated due to the action of the vertical splines 43*a, b*. The hydraulic fluid enters and leaves the lower cavity portion 40 through port 44. The shaft 24 is provided with a hollow bore 46 extending axially along the shaft 24 for conduction of hydraulic fluid into and out of the upper cavity portion 38. The hydraulic fluid enters the bore 46 at input port 48 and communicates with upper cavity portion 38 at port 50. In this manner hydraulic fluid can enter the upper cavity portion 38 through port 48 and leave the lower cavity portion 40 through port 44 for driving piston 34 downwardly causing the piston 34 to rotate in a first predetermined direction as determined by the angled splines 30, 36. Alternately, hydraulic fluid can enter lower cavity portion 40 through port 44 and leave upper cavity portion 38 through port 50 bore 46 and port 48 causing piston 34 to move upwardly along the axis of shaft 24 causing piston 34 and shaft 24 to rotate in the opposite rotational direction as determined by the angled splines 30, 36.

Figure 3:
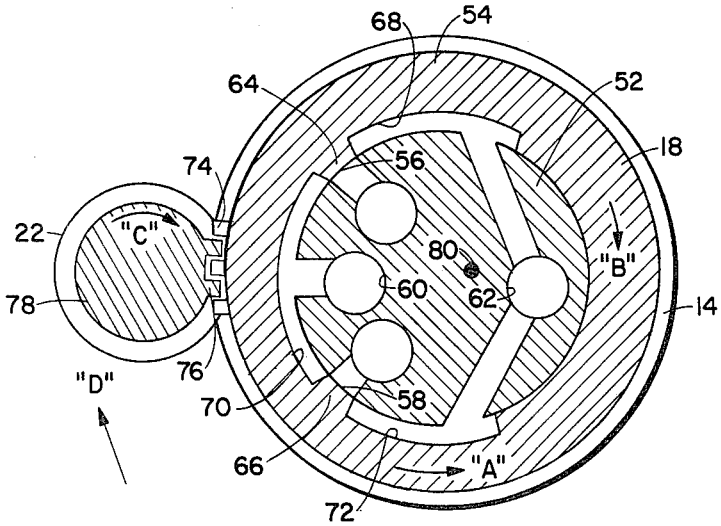
FIG. 3 shows, on an enlarged scale, a cutaway view of the hydraulic valve and stepper motor shown in FIG. 1.

The entry of hydraulic fluid under pressure into ports 44, 48 as described hereinabove is controlled by valve 18 which is disposed at the base of the actuator 12 concentric with shaft 24. Referring now to FIG. 3, valve 18 comprises a central circular body portion 52 disposed concentric with the loer portion of the actuator 12 and a hollow cylindrical portion 54 concentric with and surrounding the body portion 52. The outer surface of the body portion 52 is provided with aperture ports 56, 58 for supplying and receiving hydraulic fluid to and from actuator 12. The hydraulic fluid is provided under pressure by an external supply (not shown), enters valve 18 at supply port 60 and is returned to the supply through return port 62.

The inner surface of the cylindrical portion 54 is provided with lands 64, 66 and grooves 68, 70 and 72 for switching the hydraulic fluid between ports 56, 58, 60 and 62. In the neutral, equilibrium, or closed position of valve 18, as shown in FIG. 3, the lands 64, 66 just cover respective ports 56 and 58, grooves 68, 72 communicate with port 62, and groove 70 communicates with port 60. In this position, hydraulic fluid provided by supply port 60 fills groove 70 and hydraulic fluid from return port 62 communicates with grooves 68, 72. In the closed position, the lands 64, 66 just cover ports 56, 58 and prevent hydraulic fluid from communicating between ports 56, 58 and ports 60, 62 thereby deactuating actuator 12.

When the cylindrical portion 54 is rotated slightly counter-clockwise with respect to the body portion 52, as shown by the arrow "A", lands 64, 66 are rotated in the direction of arrow "A" and port 60 is connected to port 58 and port 56 is connected to port 62. In a like manner, when cylindrical portion 54 is rotated clockwise in the direction of arrow "B" with respect to the body portion 52, port 60 is connected to port 56 and port 58 is connected to port 62, or in other words, ports 56 and 58 are reversed with respect to the supply and return ports 60, 62 thereby changing the direction of pressure and conduction of hydraulic fluid respectively received or returned from the ports 60, 62.

The ports 56, 58 are connected to actuator ports 44, 48 of actuator 12. Thus, the direction of rotation of the cylindrical portion 54 with respect to the body portion 52 will determine which of ports 44 or 48 of actuator 12 are supply or return hydraulic ports and thereby will determine in which axial direction the piston 34 will be powered along the axis of shaft 26 and in which direction shaft 26 will be rotated by piston 34 due to the interaction of angled splines 30, 36 as explained above.

The outer surface of cylindrical portion 54 is provided with a spur gear 74 which is driven by a complimentary spur gear 76 disposed on a rotor 78 of stepper motor 20. The housing 22 of stepper motor 20 is secured to the canard 14 and rotates therewith about the axis of rotation of drive shaft 26 of actuator 12 as does the cylindrical portion 54.

Stepper motor 20 is a commercially available motor operating off 28 volts electrical supply and sensitive to pulses provided by the on-board missile guidance computer. The pulses provided to the stepper motor are typically 25 milliseconds in duration with the stepper motor rotor turning 1 to 2 degrees of rotation for each received pulse. The direction of turning of the stepper motor rotor about an axis of rotation co-axial with the axis of rotation of shaft 24 and cylindrical portion 54 is determined by external circuitry. The stepper motor 20 of the present embodiment generates a torque of approximately 20 inch ounces for turning cylindrical portion 54.

Thus, when the stepper motor 20 receives actuating electrical pulses, the rotor 78 rotates with respect to housing 22 and canard 14 causing cylindrical portion 54 to rotate in step therewith through spur gears 74, 76. Upon such rotation, the appropriate ports are opened as explained hereinabove, and hydraulic fluid provided to actuator 12 causes canard 14 and housing 22 to rotate about axis of rotation shown as 80.

Heretofore, it was necessary to use an electromechanical transducer or the like for determining the current position of the canard and determining when the canard had been turned or moved the required amount corresponding to the predetermined position as determined by the electrical signal from the missile guidance computer. In such cases the transducer had to be mounted onto the canard and introduced error generating and reduced reliability components into the system.

According to the present invention, the stepper motor is mounted to the canard and moves therewith thereby providing mechanical positional feedback for determining when the electrohydraulic system should be shut off upon the canard arriving at the predetermined position. Assume that the stepper motor is actuated for rotation of stepper motor rotor 78 in the direction as indicated by arrow "C" a predetermined number of degrees with respect to housing 22. The predetermined rotation of rotor 78 is reflected through spur gears 76, 74 to cylindrical portion 54 which rotates a predetermined number of degrees in direction of arrow "A" corresponding to the ratios of the radii of rotor 78 and cylindrical portion 54. Rotation of cylindrical portion 54 in the direction of arrow "A" causes supply port 60 to be connected to aperture port 58 and return port 62 to be connected to aperture port 56, aperture ports 56, 58 being connected to corresponding ports 44, 48 of actuator 12 for rotation of shaft 26 as described above. The canard 14, powered by actuator 12 will then rotate about axis 80 in the direction of arrow "D" about axis of rotation 80. The rotor 78 having been turned the predetermined radial distance in the direction of arrow "C", is locked in place thereby locking in rotational place through spur gear 74, 76 cylindrical portion 54. Canard 14 rotating in the direction of the arrow "D" will cause the stepper motor 20 to also rotate in the direction of the arrow "D" about the axis of rotation 80. This rotation of the stepper motor 20 about the axis of rotation 80 will cause the cylindrical portion 54 to rotate in the direction of the arrow "B". Thus, when the canard 14 and stepper motor 20 have rotated by actuator 12 the required distance in the direction of the arrow "D" as determined by the actuation of rotor 78 in the direction of the arrow "C", the cylindrical portion 54 will have rotated in the direction of the arrow "B" back to its closed or neutral or null position point at which the valve 18 will have closed the ports 58 and 56 thereby stopping the flow of hydraulic fluid to actuator 12 and preventing further movement of canard 14. Thus, the mounting of the stepper motor 20 to the canard 14 provides mechanical positional feedback for determining that the rotation or movement of canard 14 has been accomplished as determined by the control guidance computer and the system then is shut off maintaining the canard in the proper position and the valve 18 in the closed or neutral position.

Thus, there is presented an electrohydraulic control system with mechanical position sensing feedback. A movable flight control canard is rotatably operated for providing flight control of the missile. A hydraulically powered actuator is mounted to the airframe with the canard being secured to the actuator shaft for controlled rotation of the canard with respect to the airframe of the missile. Hydraulic fluid under pressure enters the actuator at its base via a rotary valve. A stepper motor is mounted to the canard and is geared to drive the rotary valve as determined by digital control signals generated by the missile guidance computer. When the stepper motor receives a train of pulses, the stepper motor rotor rotatingly moves the rotary valve from the neutral or closed position to an open position for admitting hydraulic fluid into the rotary actuator thereby causing the canard to turn. The stepper motor rotates along with the canard and provides position feedback for closing the rotary valve when the canard has reached the equilibrium position determined by the control signal.

While there has been illustrated and described what is at present considered to be the preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. A hydraulic system for positioning a movable member which is mounted for rotation about an axis, said hydraulic system comprising:

actuator means for positioning said movable member, said actuator means being connected to said movable member and responsive in rotation about said axis to hydraulic fluid under pressure;

valve means operatively connected to said actuator means for controlling said hydraulic fluid, said valve means being actuatable between a first state preventing transmission of hydraulic fluid pressure to said actuator means and conduction of hydraulic fluid from said actuator means and at least one additional state permitting transmission of hydraulic fluid pressure to said actuator means and conduction of hydraulic fluid from said actuator means, said valve means being configured for movement about said axis; and servo control means responsive to a control signal and operatively connected to said valve means for controlling said valve means between said first state and said additional state, said servo control means being attached to said movable member and movable about said axis.

2. A hydraulic system as set forth in claim 1 wherein said actuator means comprises:

a housing open at one end and having walls defining a cylindrical chamber, said walls further defining helical threads, said housing defining first and second fluid passageways communicating with said cylindrical chamber at a location opposite said open end;

a cylindrical piston having an external surface defining cooperating helical threads and a splined central bore, said piston being disposed within said cylindrical chamber in threaded engagement with said wall helical threads and dividing said cylindrical chamber into a first volume adjacent said housing open end and a second volume in communication with said second fluid passageway;

a shaft having a first end configured for attachment to said movable member, said shaft penetrating said housing through said open end, traversing said first volume, penetrating said splined central bore of said piston, traversing said second volume, and terminating in a second end mounted adjacent said first fluid passageway in said housing for rotation about said axis, said shaft defining cooperating splines in said cylindrical chamber slidably engaging said splined central bore of said piston, said shaft having a central passageway communicating between said first fluid passageway and said first volume.

3. A hydraulic system as set forth in claim 2 wherein said valve means comprises:

a valve body having a hydraulic fluid pressure passage and a hydraulic fluid return passage; and sleeve means mounted for rotation on said valve body for selectively connecting said hydraulic fluid pressure passage with one of said first and second fluid passageways and said hydraulic fluid return passage with the other of said first and second fluid passageways.

4. A hydraulic system as set forth in claim 3 wherein said servo control means comprises:

a stepper motor;

a first gear mounted for rotation by said stepper motor; and a second gear mounted on said sleeve means and held in meshing engagement with said first gear.

* * * * *